US005095843A

United States Patent [19]

Kobayashi

[11] Patent Number: 5,095,843

[45] Date of Patent: Mar. 17, 1992

[54] STORAGE AND BUOYANCY DEVICE FOR SMALL WATERCRAFT

[75] Inventor: Noboru Kobayashi, Iwata, Japan

[73] Assignee: Yamaha Hatsudoki Kabushiki Kaisha, Iwata, Japan

[21] Appl. No.: 700,335

[22] Filed: May 6, 1991

Related U.S. Application Data

[63] Continuation of Ser. No. 412,849, Sep. 26, 1989, abandoned.

[30] Foreign Application Priority Data

Sep. 26, 1988 [JP] Japan ..... 63-242126

[51] Int. Cl.[5] ..... B63B 17/00

[52] U.S. Cl. ..... 114/360; 114/68

[58] Field of Search ..... 114/68, 69, 78, 121, 114/123, 264, 266, 267, 343, 347, 360, 363, 364

[56] References Cited

U.S. PATENT DOCUMENTS

| | | | |
|---|---|---|---|
| 611,021 | 9/1898 | Pendleton | 114/360 |
| 883,588 | 3/1908 | Thatcher | 114/347 |
| 2,848,725 | 8/1958 | Slouvin | 114/360 |
| 3,665,532 | 5/1972 | Simpson | 114/347 |
| 3,952,350 | 4/1976 | Moucka | 114/68 |
| 4,161,796 | 7/1979 | Kostanecki | 114/39.1 |
| 4,760,810 | 8/1988 | Kobayashi | 114/56 |
| 4,802,435 | 2/1989 | Choi | 114/360 |

FOREIGN PATENT DOCUMENTS

| | | |
|---|---|---|
| A13030469 | 8/1980 | Fed. Rep. of Germany . |
| 53-10157 | 3/1978 | Japan . |
| PCTUS8401-221 | 4/1985 | PCT Int'l Appl. . |

*Primary Examiner*—Sherman Basinger
*Assistant Examiner*—Clifford T. Bartz
*Attorney, Agent, or Firm*—Ernest A. Beutler

[57] ABSTRACT

Several embodiments of hull configurations for small watercraft wherein the gunnels at the side of the watercraft are raised and provided with sealed storage areas that increase the buoyancy of the hull and which can be flooded for assisting in re-entry.

7 Claims, 3 Drawing Sheets

STORAGE AND BUOYANCY DEVICE FOR SMALL WATERCRAFT

This is a continuation of U.S. patent application Ser. No. 412,849, filed Sept. 26, 1989 now abandoned.

BACKGROUND OF THE INVENTION

This invention relates to a storage and buoyancy device for a small watercraft and more particularly to an improved arrangement for storing articles in a small watercraft and also for improving the buoyancy of such a watercraft as well as affording a means whereby the watercraft buoyancy chamber can be flooded so as to assist in reentry.

There is a class of small watercraft that is increasing in popularity. This type of watercraft is propelled by a jet propulsion unit and thus offers great versatility. Although this type of watercraft has great versatility because of its small size, its use for certain purposes such as fishing have been quite limited. For example, although such watercraft are highly adaptable as fishing boats, the type watercraft previously proposed have not afforded any area wherein fishing paraphernalia such as fishing poles or other articles may be carried.

It is, therefore, a principle object of this invention to provide an improved hull construction for a small watercraft wherein a storage capacity is provided for bulky objects.

The hulls for these small watercraft also, because of their compact nature, may not be sufficiently buoyant so as to afford the desired degree of stability. It is, therefore, a still further object of this invention to provide an improved arrangement for increasing the buoyancy of the hull of a small watercraft.

Although it is desirable that the hull have a high degree of buoyancy for stability purposes, frequently the rider may wish to enter the body of water in which the watercraft is operating from the watercraft. Of course, therefore, it is also necessary for the ride to be able to re-enter the watercraft. If the hull has too much buoyancy it can be very difficult for the rider to re-enter the watercraft. Therefore, it is a still further object of this invention to provide an improved buoyancy device for a small watercraft wherein the buoyancy can also be changed so as to decrease the buoyancy and make it easier for a rider to re-enter the watercraft.

SUMMARY OF THE INVENTION

The features of this invention are adapted to be embodied in a hull for a small watercraft that is comprised of a depressed rider's area bounded by a pair of longitudinally extending gunnels.

In accordance with a first feature of the invention, a storage area is formed at the upper end of a least one of the gunnels and selectively openable closure means afford access to the this storage area.

In accordance with another feature of the invention, buoyant areas are formed at the upper ends of the gunnels for increasing the stability of the hull.

DETAILED DESCRIPTION OF THE PREFERRED EMBODIMENTS

Figure 1:
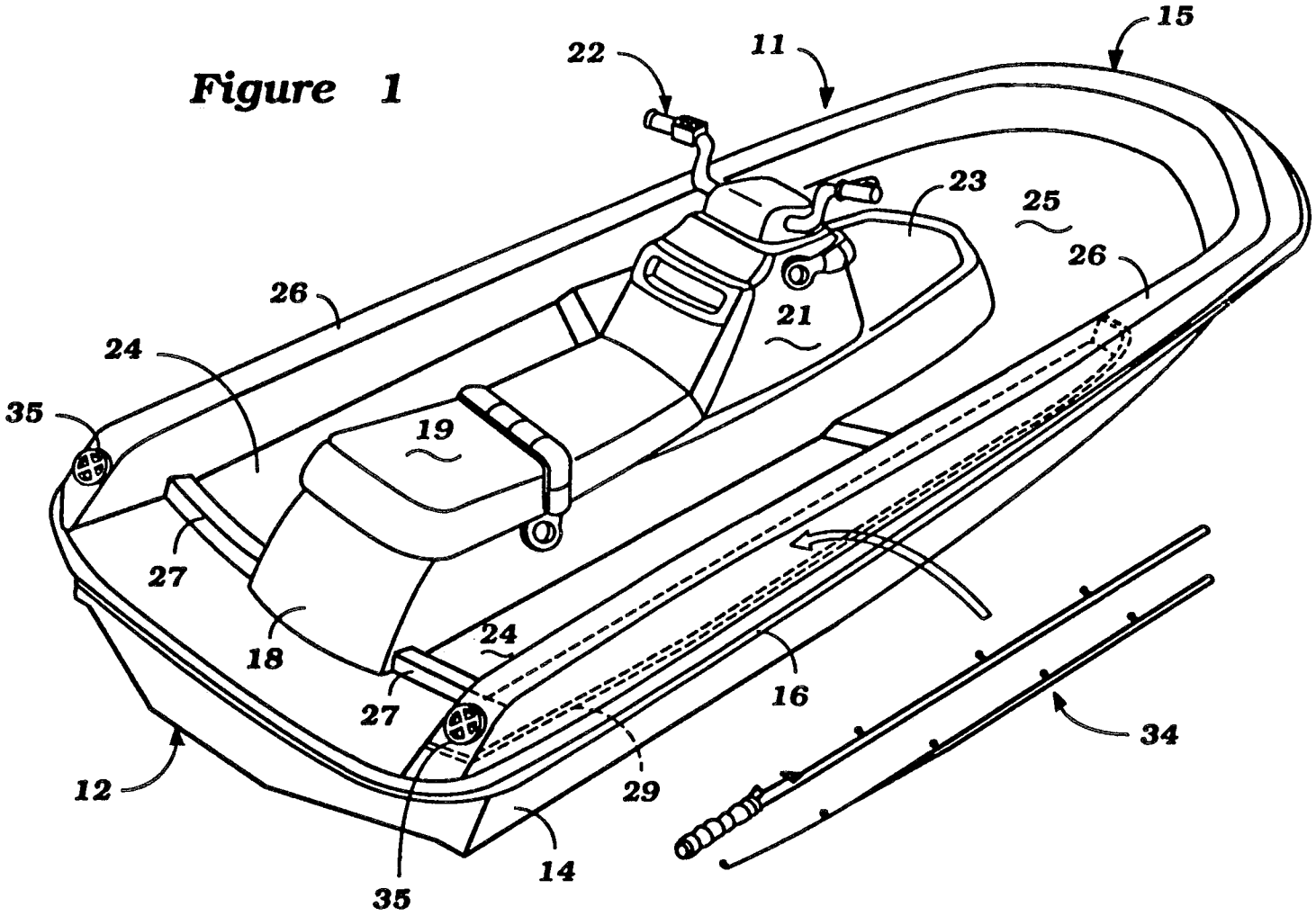
FIG. 1 is a top rear perspective view of a small watercraft having a hull constructed in accordance with an embodiment of the invention and showing how a bulky article such as a fishing pole can be stored within the hull.
Figure 2:
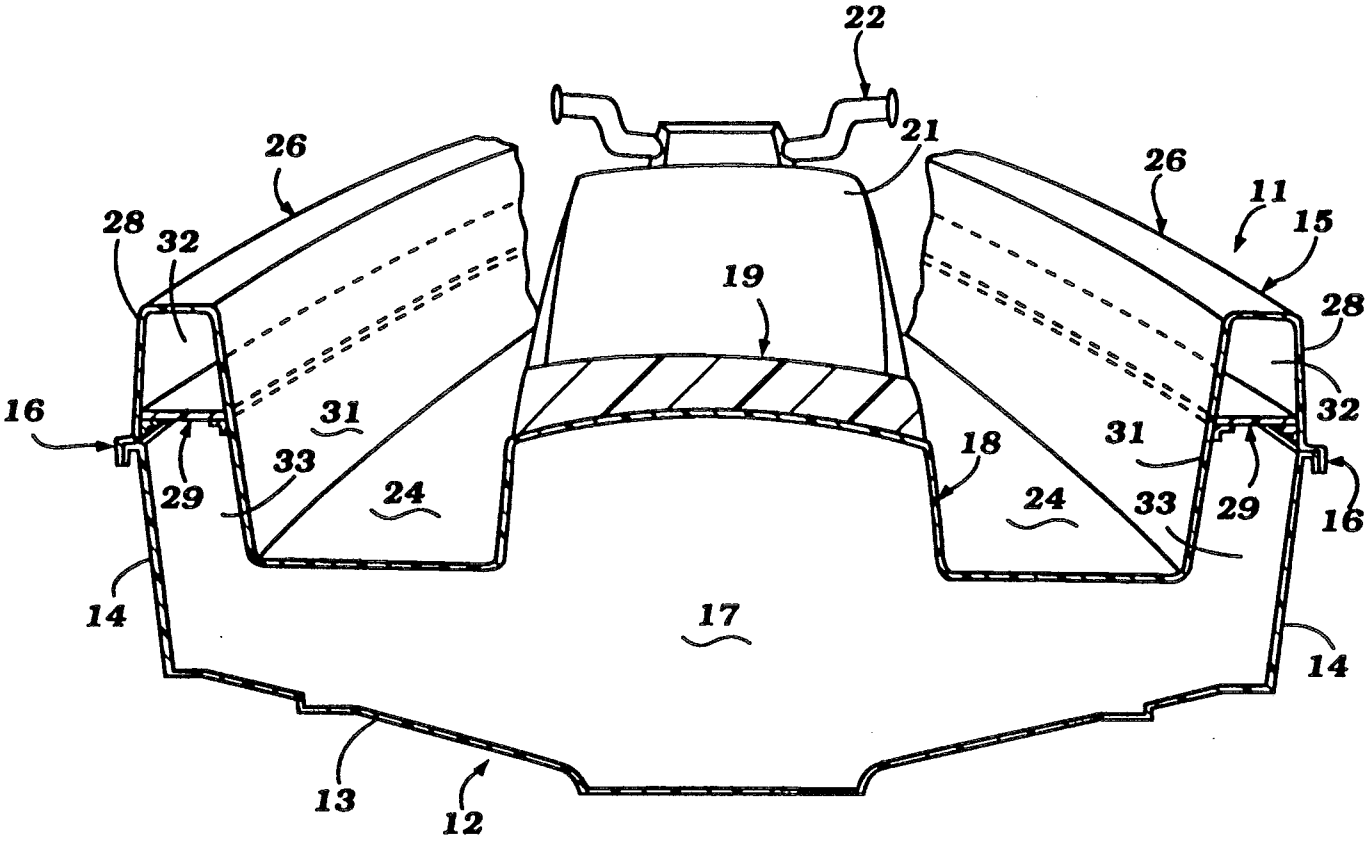
FIG. 2 is an enlarged transverse cross sectional view taken through the hull.

Referring first to the embodiments of FIGS. 1 and 2, a small watercraft constructed in accordance with this embodiment is identified generally by the reference numeral 11. The watercraft 11 is comprised of a hull, indicated generally by the reference numeral 12 which is comprised of a lower portion 13 having a generally V-shaped surface with a pair of upstanding side walls 14. A deck, indicated generally by the reference numeral 15 is affixed to the upper ends of the side walls by means of a joint 16 that extends around the watercraft. The hull 12 and specifically the lower portions and deck 15 may conveniently be formed of a molded fiberglass reinforced resin and define a generally longitudinally extending internal cavity 17.

A raised central portion 18 of the deck 15 accommodates a rear seat 19 that is adapted to accommodate one or two riders seated in straddle fashion. A raised bridge 21 is positioned forwardly of the seat 19 and carries a handle bar assembly 22 for steering of the watercraft and also which may contain certain controls of the watercraft such as a kill switch, starter switch and the like.

A forward seat 23 is formed forwardly of the bridge 21. The forward seat 23 is adapted to accommodate one of the riders who may move from the seat 19 to the forward seat 23 when the watercraft is stationary. The balance of the watercraft is such that it will maintain stability under either condition, as described in my co-pending application entitled "Compact Planing Type Boat", Ser. No. 237,505, filed Aug. 26, 1988, now issued as U.S. Pat. No. 4,893,579, on Jan. 16, 1990, and assigned to the Assignee of this application. The disclosure of that application is incorporated herein by reference.

An engine compartment is formed within the cavity 17 and primarily beneath the area where the front seat 23 and bridge 21 are formed. An engine received in this area may be of any known type and drives a jet propulsion unit (not shown) that is positioned beneath the rear seat 19 and which has a steerable nozzle that is steered by the handle bar assembly 22. Since the form of propulsion unit for the watercraft 11 forms no part of the invention, a further description of it is believed to be unnecessary.

There is provided a depressed foot area for the riders around the raised portion 18 which consists of a pair of longitudinally extending foot areas 24 that are joined at their forward end by a foot area 25. The foot areas 24 and 25 together generally have a U-shaped configuration and permit the rider's feet to be accommodated and also afford room for the rider to move from one seat 19 to the other 23 or vice versa.

This foot area is bounded by a pair of spaced apart raised gunnels 26 which join together at the bow of the hull 12 as clearly seen in the figures. However, the foot areas 24 open through the rear of the transom so as to permit water to be drained from the foot area during righting maneuvering as described in my co-pending application entitled "Small Watercraft With Ease Of Re-entry", Ser. No. 933,615, filed Nov. 21, 1986 and assigned to the Assignee of this application. In order to preclude excess water entry into the foot well areas 24 during normal watercraft operation, there are provided a pair of raised dams 27 at the rear of the foot area. If desired, check valves (not shown) may be provided in the dams 27 so as to permit water to drain from the foot areas but not enter them.

In accordance with the invention, the gunnels 26 are provided with raised portions 28 that extend higher than normal and which are made water tight by integral walls 29 that extend transversely therealong. These walls 29 span the inner peripherial edges 31 of the gunnels that lie adjacent the foot areas 24 and extend to the outer side of the deck portion 15. These partitions 29 define sealed areas 32 which lie above an air space 33 fprned at the remaining portion of the gunnels. These areas 32 extend substantially the full length of the hull as clearly shown in FIG. 1 and can accommodate long articles such as fishing poles 34.

Removable closure plugs 35 extend across the rear ends of the openings so as to permit articles inserted and withdrawn. In addition, the closure plugs 35 may be removed and the areas 32 flooded with water to assist in re-entering the watercraft. Once the watercraft has been re-entered, the water will drain out of the storage compartments 32 as long as the closure plugs 35 are removed. Hence, the compartments 32 serve the dual purpose of providing a storage area and added buoyancy and yet also can be flooded for ease of re-entry.

Figure 3:
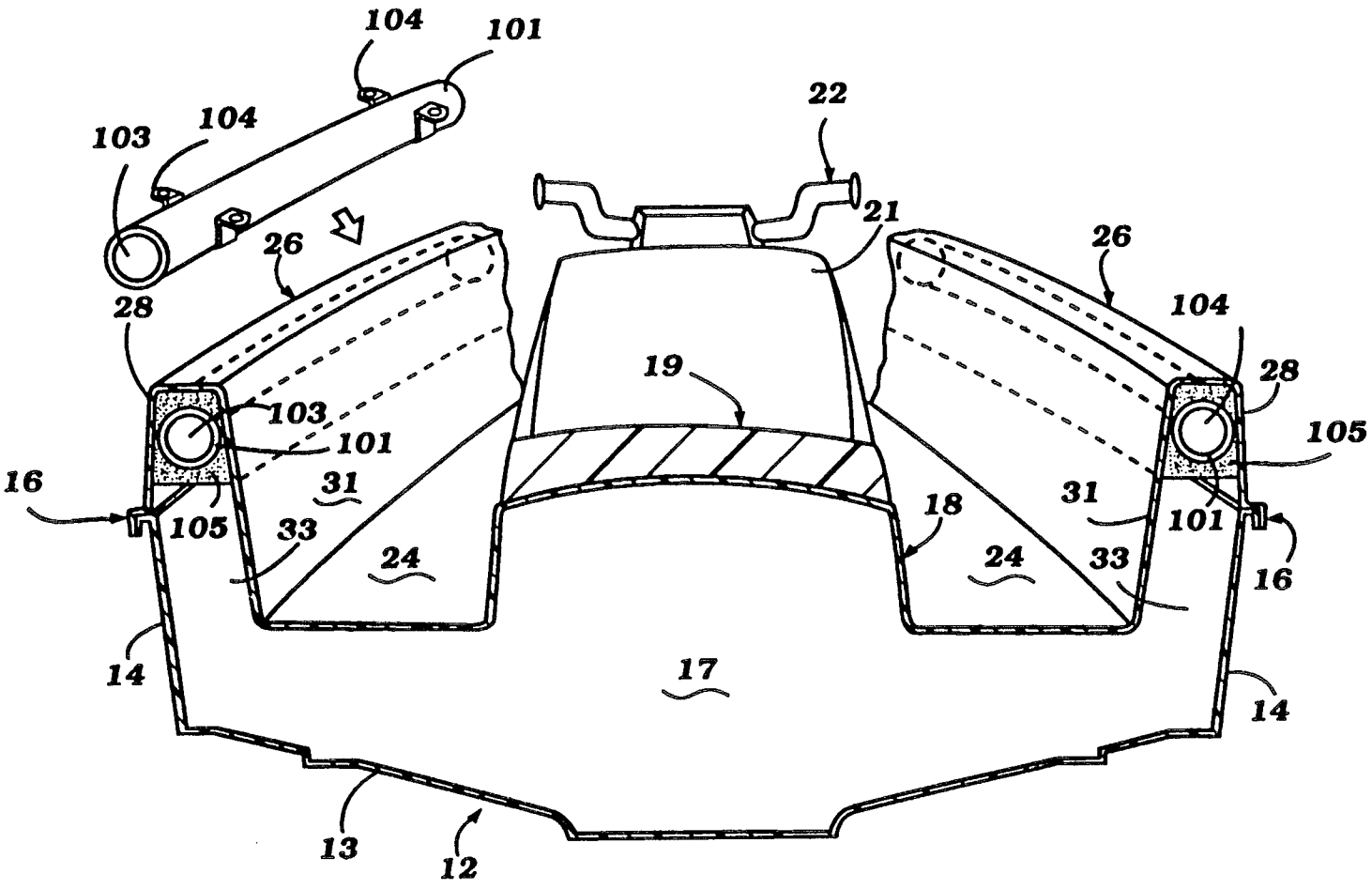
FIG. 3 is a cross sectional and partially exploded view in part similar to FIG. 2, showing another embodiment of the invention.

FIG. 3 shows another embodiment of the invention which is generally similar to the embodiment of FIGS. 1 and 2 and, for that reason, components of this embodiment which are the same as the previous one have been identified by the same reference numerals and will not be described again, except insofar as is necessary to understand the construction and operation of this embodiment.

This embodiment, a pair of storage tubes 101 of generally cylindrical configuration and which are closed at one end are secured in the upper portion of the gunnels 26 and specifically in the raised area 28. The tubes 101 have open rear ends 103 which are closed by removable closure plugs (not shown) so as the secure the articles within the cavity 101 and to make them watertight when desired.

Mounting straps 104 are secured to the tubes 101 and affix them within the gunnels 26. If desired, the buoyancy can further be increased by foaming a plastic 105 in place around the tubes 101. Therefore, this embodiment has the same advantages and same operation as that of the one previously described.

It should be apparent from the foregoing description that several embodiments of the invention have been illustrated and described and each of which is highly effective in providing a storage area in the hull of a small watercraft which also increases the buoyancy and can be flooded for assisting in re-entry. Although two embodiments of the invention have been illustrated and described, various changes and modifications can be made without departing from the spirit and scope of the invention, as defined by the appended claims.

I claim:

1. A hull for a small watercraft comprising a depressed rider's area open through the rear of said hull and bounded by a pair of longitudinally extending gunnels an elevated rider's seating area formed at the rear central portion of said hull centrally of said depressed rider's area and adapted to accommodate at least one rider seated thereon, a storage area formed at the upper end of at least one of said gunnels and extending from the rear end of said gunnel to a point disposed forwardly of said rider's seat for providing a substantial length for said storage area along at least one side of said hull, an opening at the rear of said hull communicating with said storage compartment, and selectively openable closure means for closing said opening and for affording access to said storage area when opened and through which the storage area is flooded for changing the buoyancy at one side of the watercraft to assist reentry if a rider becomes displaced from said watercraft.

2. A hull for a small watercraft as set forth in claim 1 wherein the storage area is air tight when the closure means is closed for adding to the buoyancy of the hull.

3. A hull for a small watercraft as set forth in claim 1 wherein the storage area extends substantially the full length of the gunnel.

4. A hull for a small watercraft as set forth in claim 3 wherein there is a storage area and a selectively operable openable closure means in each of the gunnels at the upper end thereof.

5. A hull for a small watercraft as set forth in claim 1 wherein the storage area is surrounded by a buoyant mass.

6. A hull for a small watercraft as set forth in claim 5 wherein the storage area is air tight when the closure means is closed for adding to the buoyancy of the hull.

7. A hull for a small watercraft as set forth in claim 6 wherein the storage area can be flooded upon partially depressing the hull and removing the closure means for assisting in re-entry.

* * * * *